United States Patent [19]

Heimann

[11] 4,084,741

[45] Apr. 18, 1978

[54] CONTINUOUS FORM MULTIPLE PLY ENVELOPE ASSEMBLY

[75] Inventor: Edward W. Heimann, Woodridge, Ill.

[73] Assignee: Wallace Business Forms, Inc., Hillside, Ill.

[21] Appl. No.: 820,101

[22] Filed: Jul. 29, 1977

[51] Int. Cl.[2] ..... B65D 27/10

[52] U.S. Cl. ..... 229/69

[58] Field of Search ..... 229/69; 282/11.5 R, 282/11.5 A

[56] References Cited

U.S. PATENT DOCUMENTS

| | | | |
|---|---|---|---|
| 2,723,077 | 11/1955 | Whitman | 229/69 |
| 2,790,593 | 4/1957 | Reuter | 229/69 |
| 3,554,447 | 1/1971 | Sebring | 229/69 |
| 3,580,488 | 5/1971 | Komen | 229/69 |
| 3,786,984 | 1/1974 | Malenge | 229/69 |

*Primary Examiner*—Stephen P. Garbe

*Attorney, Agent, or Firm*—Neuman, Williams, Anderson & Olson

[57] ABSTRACT

In this continuous form multiple ply envelope assembly each individual envelope is formed by a back ply and a folded top ply. The top ply is secured to a portion of a continuous common web serving as both the back ply for an individual envelope and the means for transporting the assembly through automated business processing equipment. The top ply comprises a central area, two side panels folded inwardly to cover a portion of the central area, a bottom flap folded to overlay both a portion of the side panels and a portion of the central area and lastly a top flap. The top ply is secured to the portion of the continuous web serving as the back ply by lines of adhesive positioned along the side panels, the portion of the bottom flap covering the side panels and along the transverse edge of the bottom flap. A receiving pocket is formed in each envelope between the folded bottom flap and the back ply. The top flap of the top ply of one envelope is disposed within the receiving pocket of the adjacent envelope to hold the top flap flat during processing to avoid jamming of the automated equipment or tearing of the continuous form assembly. The receiving pocket is separate and distinct from the normal material holding area at the interior of the individual envelope.

16 Claims, 5 Drawing Figures

CONTINUOUS FORM MULTIPLE PLY ENVELOPE ASSEMBLY

BACKGROUND OF THE INVENTION

1. Field of the Invention

This invention relates to a continuous form multiple ply envelope assembly of the type which is automatically processed on computers, automatic typewriters or other business processing machines by imprinting indicia on the face of the envelope. After processing of the continuous form assembly, the individual envelopes are separated from the continuous form by automated "bursting" machines. Thereafter, the individual envelopes are automatically stuffed with material to be mailed. Of course, each of the above operations of imprinting, separating the continuous assembly into the individual envelopes and stuffing the individual envelopes could be manually performed.

While the present invention is described herein with reference to particular embodiments, it should be understood that the invention is not limited hereto. The envelope assembly of the present invention may be employed in a variety of forms, as those skilled in the art will recognize in light of the present disclosure.

2. Description of the Prior Art

Continuous form envelope assemblies of the general type described herein are well-known in the prior art. Representative of such prior art are such U.S. Pat. Nos. as Sebring 3,554,447 and Porter 3,273,784. A frequent difficulty or problem with continuous form envelope assemblies in common use is the catching or snagging of a free or loose edge of the individual envelope during machine processing.

When an edge of an individual envelope becomes entangled in the processing machine the individual envelope is normally destroyed beyond use and frequently the tearing is so extreme that the continuous assembly of envelopes is severed completely. Furthermore, when an individual envelope becomes jammed in the processing machine or the continuous form becomes severed the operator must stop the machine to clear the jam or rethread the continuous form. This type of manual operation is extremely time consuming and results in an intolerable amount of machine down time. Any amount of machine down time detracts from the ultimate benefit of machine processing and increases the overall cost of an operation.

One type of continuous form envelope assemblies includes a series of completely preformed envelopes which are glued to a common carrier web. This common carrier web forms no part of the actual envelope and is used solely as a transporting medium for the individual envelopes through the business processing machines. The top flap of each envelope structure is placed under the preceding envelope not to reduce the jamming and tearing tendency of a free edge but for alignment purposes on the common carrier. The top flap is usually glued to the carrier web and is the only means securing the individual envelopes to the common web. This approach reduces the likelihood of the top flap snagging in the processing machines and the top flap of each envelope is traditionally the area most susceptible to jamming or catching during processing. However, the remaining body of the individual envelope remains free and detached from the carrier web for movement away from the carrier web and is capable of catching in the machine with the same detrimental results.

A further problem experienced with this type of envelope assembly occurs during separation of the individual envelopes after printing. The areas at which the envelope are glued to the carrier web do not separate cleanly but rather retain a thin strand or strip of paper from the carrier web. This is unsightly and detracts from the appearance of the envelope even if the glue spots holding the individual envelopes to the carrier web are placed at interior areas of the envelope. Also this type of continuous envelope assembly cannot be used with conventional "bursting" machines which automatically separate the contiguous assembly. Therefore manual separation is necessary with the attendance cost increase and potential for error.

In addition, this type of envelope assembly in which the individual preformed envelopes are glued to a common carrier for processing results in a waste of paper. The carrier web forms no portion of the envelope and is merely discarded at the termination of processing.

It is therefore a general object of this invention to cope with the problems of such prior art assemblies.

Another object is to provide a continuous form envelope assembly without free edges to snag during machine processing. A further object is to provide a continuous form envelope assembly with the top flap of each envelope positioned within a receiving pocket formed in the preceding envelope.

Another object is to provide a continuous form envelope assembly with a receiving pocket which does not interfere with or diminish the normal size of the material receiving area of the envelope.

Another object is to provide a continuous form envelope assembly that reduces unnecessary paper waste occasioned by a throwaway carrier web.

A still further object is to employ a common web with the dual function of forming the back ply of each individual envelope and of serving as a continuous carrier for the assembly during processing.

Other objects will be apparent from the following summary and detailed description.

SUMMARY OF THE INVENTION

The present invention relates to a continuous form multiple ply envelope assembly which overcomes the disadvantages of the prior assemblies and otherwise achieves the foregoing objects.

A plurality of individual envelopes are formed each having an independent top ply secured by adhesive means such as glue lines to a back ply which is a portion of a continuous common carrier web. The continuous common carrier web has the dual function of transporting the envelope assembly during processing and being an actual portion of each individual envelope. The individual envelopes so structured form a continuous envelope assembly by reason of the contiguous common carrier. The front ply of each envelope is separately formed and secured to the continuous web. The front ply comprises a central area, a top flap, two side panels which fold inwardly to cover a segment of the reverse side of the central area and a bottom portion which folds inwardly to overlay a portion of the side panels and a portion of the reverse side of the central area.

Adhesive means such as glue lines are placed along the folded side panels and the side edges of the bottom portion overlaying the side panels and across the inwardly folded transverse edge of the bottom portion.

The front ply with the adhesive means is positioned upon the continuous web serving as the back or bottom ply thereby forming an individual envelope. Of course, it should be apparent that the glue could be applied to the continous web and the folded front ply applied to the glue. Further, while the term "lines" is used in conjunction with the term "glue lines" it should be apparent that the lines have a substantial area.

A receiving pocket is formed between the back ply portion of the continuous web and the folded bottom portion of the front ply. The receiving pocket is separate and distinct from the normal material receiving area of the envelope. The normal material receiving area of the individual envelope is formed between the folded bottom portion of the front ply, the back ply portion of the continuous web above the transverse edge of the bottom portion and the central area of the front ply. Thus, the material receiving area is not diminished in size by the folded top ply. The top flap of the succeeding envelope of the assembly is positioned within the receiving pocket of the preceding envelope when the front ply of this succeeding envelope is adhered to the continuous web.

The receiving pocket is a structural element of each actual individual envelope. During processing the top flap of each envelope is held securely in positive registration within the receiving pocket of the preceding envelope without the aid of adhesive. The continuous common web is divided by lines of weakening into appropriate portions which serve as the back ply for an individual envelope. In addition, the longitudinal border of the common web has punched strips to aid in movement of the assembly during processing and these strips are separated from the area serving as the back ply by lines of weakening. After an individual envelope is separated from the continuous form assembly along the transverse line of weakening, the receiving pocket being only two plies of paper thick lies flat and is substantially unnoticeable. Furthermore, since the top ply is bonded to the back ply portion of the continuous web and the top flap secured with the preceding envelope's receiving pocket, no edges or areas are free to become entangled during processing.

BRIEF DESCRIPTION OF THE DRAWINGS

The present invention will be more clearly understood from the following detailed description read in conjunction with the accompanying drawings, in which.

DETAILED DESCRIPTION

Figure 1:
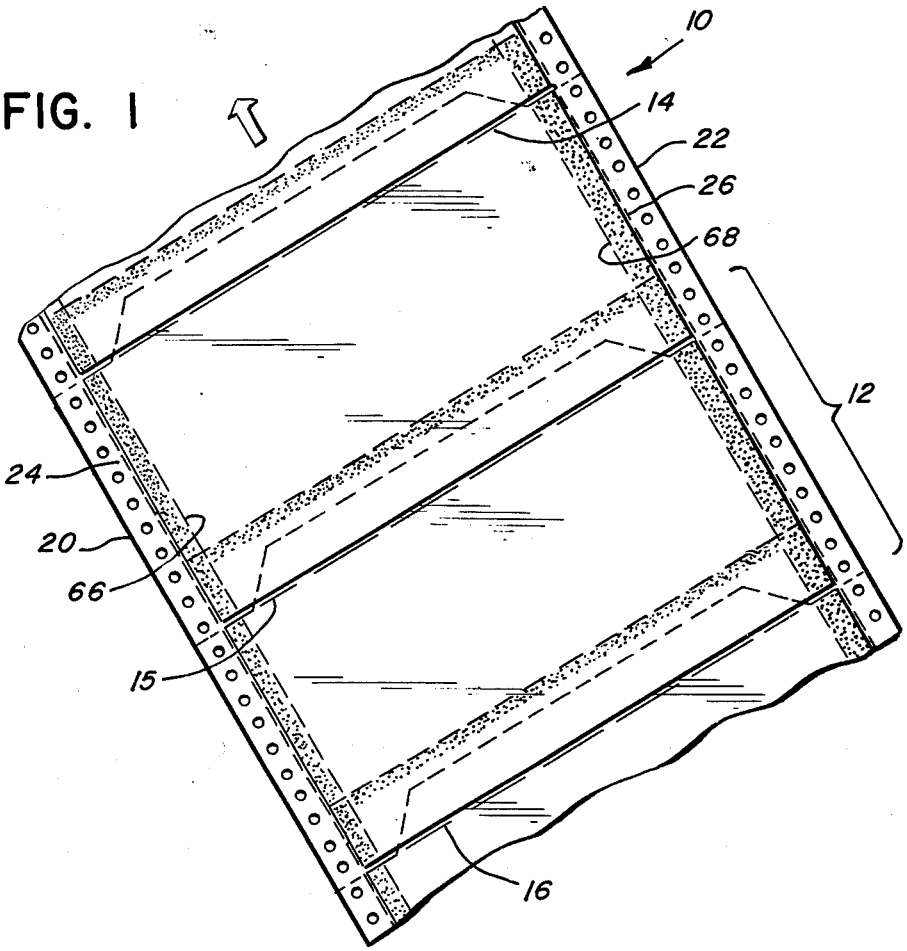
FIG. 1 is a top view of the continuous form envelope assembly of the present invention showing several envelopes in contiguous relationship.
Figure 2:
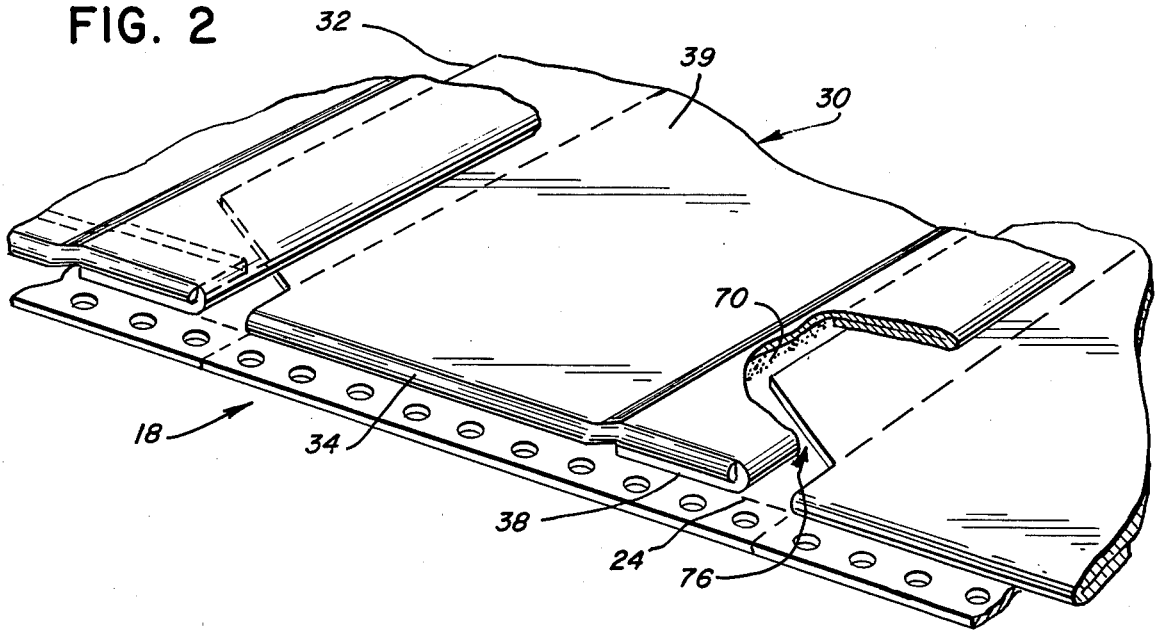
FIG. 2 is a cut away and diagrammatical view of the continuous assembly showing the position of the preceding envelope's receiving pocket and the top flap of the succeeding envelope.

Referring to FIGS. 1 and 2 the continuous form envelope assembly 10 of the present invention consists of a series of individual envelopes 12 which are interconnected by lines of weakening, such as lines of perforation 14, 15 and 16. The lines of perforation 14, 15 and 16 extend transversely across the continuous form common web 18, refer to FIG. 5, and provide a means for separating the individual envelopes 12 after processing by conventional business machine techniques.

The common web 18 has control punching strips 20 and 22 along the sides thereof to provide for registration during fabrication and movement during machine processing. Lines of perforation 24 and 26 run along each side of the common web 18 inwardly adjacent the registration holes in strips 20 and 22. The lines of perforation 24 and 26 provide an easy and convenient means for removing the control punching strips 20 and 22 from the individual envelope 12 after machine processing. The area or portion of the common web 18 between two adjacent transverse lines of perforation such as 15 and 16 and between the longitudinal lines of perforation 24 and 26 form the bottom or back ply 28 of an individual envelope 12, refer to FIG. 5. Thus, common web 18 performs the dual function of serving as both the carrier for the envelope assembly and a structural element of each individual envelope.

Figure 4:
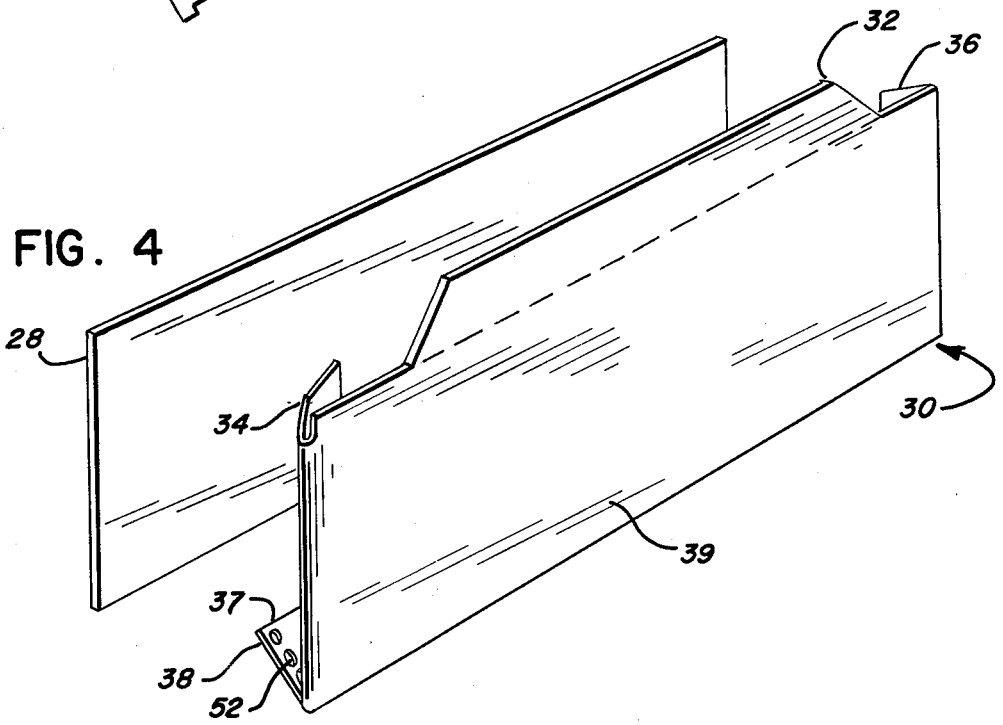
FIG. 4 is an exploded view of an individual envelope showing the folded top ply in detail.

FIG. 1 is a top view of the envelope assembly 10 which would be moving in the direction of the arrow when used with automated business processing machines. The envelope assembly 10 of FIG. 1 includes a series of integral and contiguous individual envelopes 12. Each envelope has in addition to the bottom ply portion 28, a structured or folded front ply 30, as shown in FIGS. 2 and 4. After the individual envelopes are completely constructed but yet integral with one another along the bottom ply 28 and the printing indicia placed on the front, the envelopes may be separated by a bursting machine or other automatic device or by hand along the lines of perforation 14, 15 and 16. The top or front ply 30, as best shown in FIG. 4, comprises a top flap portion 32, side panels 34 and 36 and a bottom portion 38 and the central portion 39.

Figure 3:
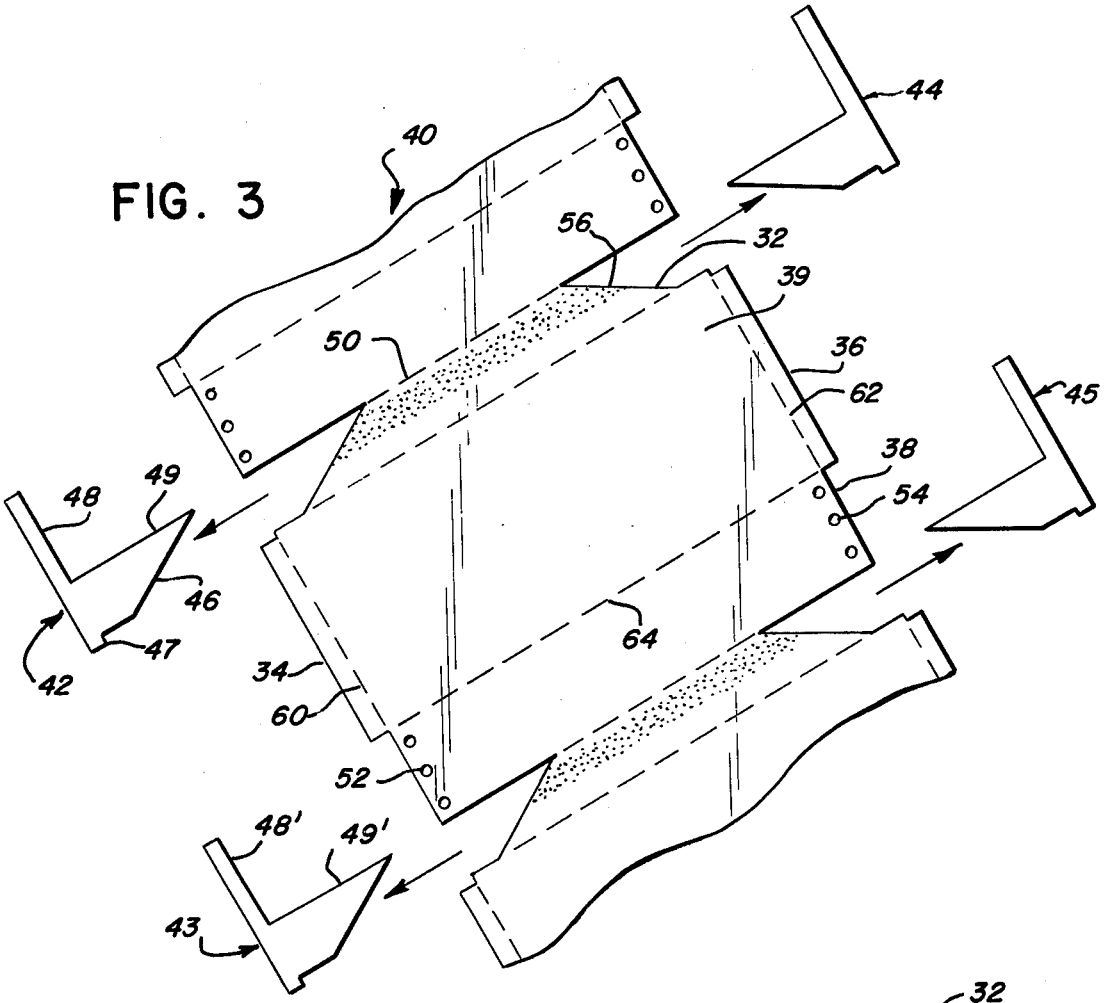
FIG. 3 is a top view of the top ply during formation.

Individual top plies for each envelope assembly are formed from a continuous ribbon of paper 40, as illustrated in FIG. 3. A punch, rotary die or other suitable means removes segments 42, 43, 44 and 45 from the continuous ribbon 40. The segments 42 through 45 are identical in shape except, of course, 42 and 43 being reverse images of 44 and 45. Segment 42 has an angular side 46, a shallow shoulder 47, an upwardly extending leg 48 and horizontal ledge 49. The angular side 46 together with the horizontal ledge 49 form the complementary angular side of the top flap 32 of the individual envelope 12. The shallow shoulder 47 forms the uppermost edge of the side panel 34. The upwardly extending leg 48 of the segment 42 relates to the preceding envelope structure, however, the corresponding upwardly extending leg 48' of segment 43 and horizontal ledge 49' form the outline of the bottom flap 38 and the lowermost edge of side panel 34. The other segments 44 and 45 operate in a complementary fashion on the right hand side of continuous ribbon 40 as viewed in FIG. 3 and are therefore not described in detail. The removal of the four segments 42 through 45 form the configuration of the top ply 30 of an individual envelope 12 as well as forming a portion of the preceding and following top plies of other individual envelopes.

A series of holes 52 and 54 are punched by conventional means in the longitudinal edge of the bottom portion 38. A line of resealable glue 56 is placed along the top flap 32. This glue will be used later to seal the envelope. The top flap of each individual envelope is connected to the bottom flap of the preceding envelope along a line of perforation 50. The connection between the top flap 32 and the bottom portion 38 of adjacent envelope top plies is severed along line 50 and each individual top ply is separated from the adjacent top ply.

As can be seen in FIGS. 3 and 4, the top ply 30 is then formed by having the side panels 34 and 36 fold inwardly along lines 60 and 62 to cover a portion of the reverse side of the central portion 39 of the front ply 30. Next, the bottom flap 38 is folded along line 64 to overlay a portion of each side panel 34 and 36 and a portion of the reverse side of the central portion 39 of the front ply 30. The portion of each side panel 34 and 36 which the bottom portion 38 overlays is best illustrated in FIG. 4. The apparatus to accomplish the folding of the top ply 30 is well-known in the paper handling art and further description is deemed unnecessary.

Figure 5:
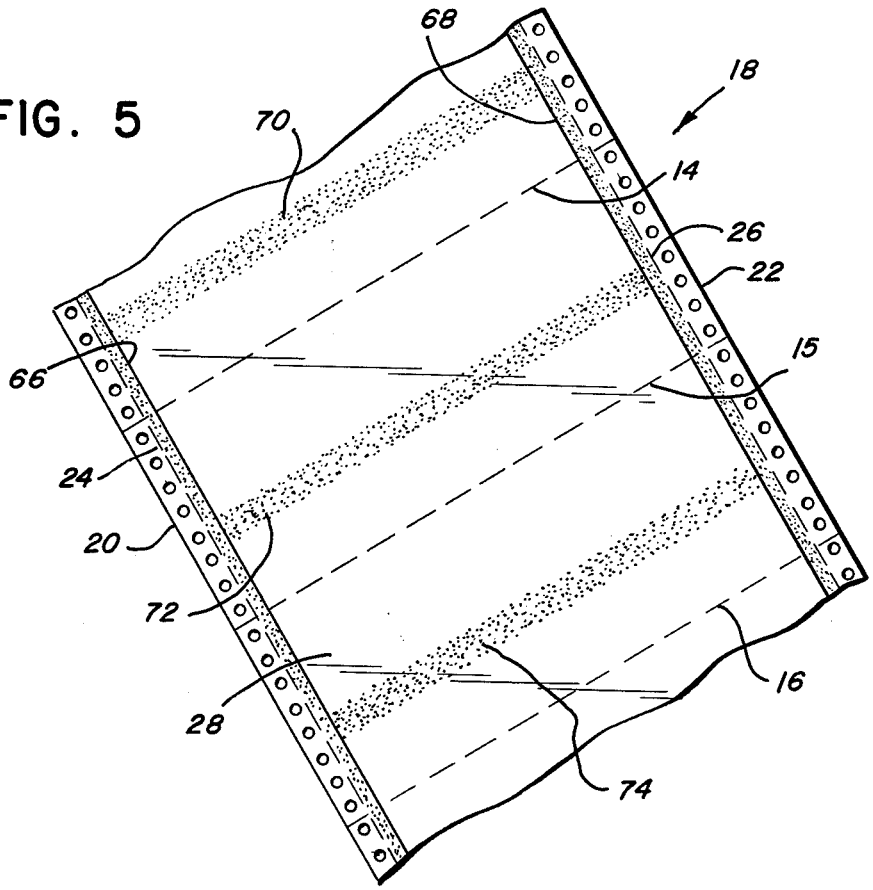
FIG. 5 is a view of the continuous web with the lines of adhesion and lines of weakening illustrated.

A pair of longitudinal glue lines 66 and 68, as seen in FIGS. 1 and 5, are applied to the bottom ply 18. The portion of bottom ply 18 forming the back ply 28 is symbolically represented in FIG. 3 for ease of understanding its relationship to top ply 30. A transverse glue line 70, 72, and 74 is also applied to each bottom ply portion serving as the back ply for an individual envelope respectively. Each transverse glue line 70, 72 and 74 is applied across bottom ply 18 about one-fourth the way up from its bottom edge so that it will align with the top edge 37 of the folded bottom portion 38 of the top ply 30. Of course, the amount of central area 39 that the bottom portion 38 overlays and correspondingly the positioning of the transverse glue lines 70, 72 and 74 can be varied. The contact of the folded bottom flap portion 38 with the transverse glue line 70 is illustrated in FIG. 2. The folded top ply is now placed by standard automated equipment on the continuous bottom ply so that the top edge 37 of the bottom portion 38 will meet the transverse glue line 70. The longitudinal glue lines 66 and 68 will contact the upper portion of the side panels 34 and 36 and the folded sides of the bottom portion 38. Since the bottom portion 38 has a plurality of punched holes 52 and 54, the glue applied to the strips will adhere to not only the bottom portion but also through holes 52 and 54 to that area of the side panels which the bottom portion generally overlays. Thereby a complete firm seal is made along the side portions of the individual envelope 12 while the bottom of the envelope 12 is along fold line 64.

The interior portion of the individual envelope 12 into which material is actually inserted is formed by the fold along lines 60 and 62 of the side panels 34 and 36 of top ply 30 and the fold along line 64 of the bottom portion 38. Thus the actual material receiving area of the individual envelope is substantially similar to the conventional envelope structure. The other receiving area or portion 76 as best illustrated in FIG. 2, is formed by the portion of the back ply 28 below transverse glue line 70, side or longitudinal glue lines 66 and 68 below the transverse glue line 70 and the bottom flap 38. The receiving pocket 76 is an integral part of each envelope and receives the top flap of the adjacent envelope. The pocket 76 holds the otherwise loose top flap of the adjacent envelope secure during processing while allowing adhesive-free removal or separation of the individual envelopes.

As an alternative embodiment, not illustrated, the top ply is not provided with side panels 34 and 36. The top ply comprises only a top flap, a bottom flap and a central area. Longitudinal lines of adhesion, such as glue lines, are placed along the sides of the central portion of the modified top ply and along the sides of the bottom flap which overlays a part of the central portion. Thus, a double glue line is used, one to adhere the folded bottom flap to the top ply and the second to secure the top ply to the bottom or back ply. A transverse line of adhesion is applied along the edge of the folded bottom portion as in the preferred embodiment. The top ply is secured by these lines of adhesion to the portion of the continuous web serving as the back ply. The continuous web is the same structure and performs the same dual purpose of serving as a medium of moving the continuous envelope assembly through processing and forming a structural element of the actual individual envelope.

The material receiving portion of the envelope is defined by the fold line of the top flap, the fold line of the bottom flap and the longitudinal lines of adhesion. Thus, the material receiving area is reduced slightly from the preferred embodiment. The other receiving pocket is formed by the back ply below the transverse glue line, the bottom flap and the longitudinal glue lines between the back ply and the bottom flap. The top flap from an adjacent envelope is placed within the receiving pocket to accomplish the same purpose as in the preferred embodiment.

It is to be understood that the present disclosure is to be interpreted in its broadest sense and the invention is not to be limited to the specific embodiments disclosed. Furthermore, the embodiments set forth can be modified or varied by applying current knowledge without departing from the spirit and scope of the novel concepts of the invention.

Having described the invention, what is claimed is:

1. A continuous envelope assembly consisting of a plurality of individual envelopes each interconnected and wherein each individual envelope comprises:

a top ply having a central area, an integral bottom flap folded across said central area along a transverse fold line so that said bottom flap overlays a portion of said central area, and an integral top flap forming a tongue adapted for sealing said envelope;

a back ply having adhesive means along the side edges and in a line extending transversely across said back ply for securing said top ply to said back ply along the sides of said back ply and across the edge of said folded bottom flap; and a pocket formed by the portion of said back ply below said transverse line of adhesive and said folded bottom flap for receiving the top flap of an adjacent envelope.

2. A continuous envelope assembly as set forth in claim 1 wherein said top ply further comprises two integral side panels each folded along a longitudinal fold line so that said side panels overlay a portion of said central area and said bottom flap overlays both a portion of said side panels and a portion of said central area.

3. A continuous envelope assembly as set forth in claim 2 wherein said bottom flap further comprises a plurality of holes punched along the longitudinal sides so that said adhesive means along the side edges of said back ply contacts the portion of said side panels which said bottom flap overlays.

4. A continuous envelope assembly as set forth in claim 3 wherein each individual envelope comprises a material receiving area defined by said longitudinal fold lines of said side panels and said transverse fold line of said bottom flap.

5. A continuous form multiple ply envelope assembly having a plurality of individual envelopes each interconnected and adapted for automated machine processing comprising:

a continuous ribbon ply having transverse lines of perforation wherein the area between adjacent lines of perforation forms the back ply of one of said plurality of individual envelopes;

a plurality of top plies each forming the front of one of said plurality of individual envelopes;

each of said top plies having a central area, an integral bottom flap folded across said central area along a transverse fold line so that said bottom flap overlays a portion of said central area, and an integral top flap forming a tongue adapted for sealing said envelope;

adhesive means along the side edges of said back ply portion of said ribbon ply and extending transversely across said back ply for securing said top ply to said bottom along the sides of said back ply and across the edge of said folded bottom flap; and a pocket formed by the portion of said back ply below said transverse line of adhesive and said folded bottom flap for receiving the top flap of an adjacent one of said plurality of envelopes to prevent said top flap from snagging during processing.

6. A continuous envelope assembly as set forth in claim 5 wherein said continuous ribbon further comprises a strip of punched holes along both sides for moving said assembly during processing.

7. A continuous envelope assembly as set forth in claim 6 wherein said continuous ribbon further comprises longitudinal lines of perforation separating said strips of punched holes from the portion of said ribbon forming said back ply.

8. A continuous envelope assembly as set forth in claim 7 wherein said top ply further comprises two integral side panels each folded along a longitudinal fold line so that said side panels overlay a portion of said central area and said bottom flap overlays both a portion of said side panels and a portion of said central area.

9. A continuous envelope assembly as set forth in claim 8 wherein said bottom flap further comprises a plurality of holes punched along the longitudinal sides so that said adhesive means along the side edges of said back ply contacts the portion of side side panels which said bottom flap overlays.

10. A continuous envelope assembly as set forth in claim 9 wherein each individual envelope comprises a material receiving area defined by said longitudinal fold lines of said side panels and said transverse fold line of said bottom flap.

11. A continuous envelope assembly as set forth in claim 5 where said top ply further comprises two integral side panels each folded along a longitudinal fold line so that said side panels overlay a portion of said central area and said bottom flap overlays both a portion of said side panels and a portion of said central area.

12. A continuous envelope assembly as set forth in claim 11 wherein said bottom flap further comprises a plurality of holes punched along the longitudinal sides so that said adhesive means along the side edges of said back ply contacts the portion of said side panels which said bottom flap overlays.

13. A continuous envelope assembly as set forth in claim 12 wherein each individual envelope comprises a material receiving area defined by said longitudinal fold lines of said side panels and said transverse fold line of said bottom flap.

14. A continuous form multiple ply envelope assembly consisting of a plurality of individual envelopes each interconnected comprising:

a continuous ribbon ply having a line of punched holes along both sides, a longitudinal line of perforation along both sides located to the interior and adjacent said punched holes and a plurality of spaced apart transverse lines of perforation extending across said ribbon ply;

each of said transverse lines of perforation interconnecting a pair of said plurality of individual envelopes;

each area of said ribbon ply defined by said longitudinal lines of perforation and adjacent pairs of said transverse lines of perforations forming the back portion of one of said envelopes;

a plurality of top plies each forming the front portion of one of said envelopes;

each top ply having a central portion, a bottom flap member folded across said central portion along a transverse line so that said bottom flap overlays a portion of said central portion and a top flap integral with said central portion forming a tongue adapted to seal said individual envelope; longitudinal lines of adhesion extending along both sides of said ribbon ply and located to the interior and adjacent said longitudinal lines of perforation for securing to said ribbon ply the longitudinal edges of said central portion above said folded bottom flap and the longitudinal edges of said bottom flap for forming the sides of one of said envelopes;

a transverse line of adhesion extending across said ribbon ply for securing the free edge of said folded bottom flap to said ribbon ply;

a receiving pocket formed by the portion of said ribbon ply below said transverse line of adhesion and said secured bottom flap; and, said top flap of each succeeding envelope of said assembly positioned within said receiving pocket of the preceding envelope to prevent loose edges during automated processing.

15. A continuous envelope assembly as set forth in claim 14 wherein said top ply further comprises:

two integral side portions folded along a line adjacent the longitudinal edges of said top ply so that said folded side portions overlay a portion of said central portion and said folded bottom flap overlays a portion of said side panels and a portion of said central portion; and said bottom flap having a line of punched holes along each longitudinal border so that said lines of punched holes overlay said folded side portions so that said longitudinal lines of adhesion contact both the edges of the bottom flap and the edges of the folded side panels covered by said bottom flap.

16. A continuous envelope assembly as set forth in claim 15 wherein each individual envelope comprises a material receiving area defined by said longitudinal fold lines of said side panels and said transverse fold line of said bottom flap.

* * * * *